United States Patent [19]

Hutchinson

[11] Patent Number: 4,928,875

[45] Date of Patent: May 29, 1990

[54] ECCENTRIC "Z" FOLD MAILER WITH NESTING CAPABILITIES

[76] Inventor: Wilbur P. Hutchinson, 318 N. School St., Mt. Prospect, Ill. 60056

[21] Appl. No.: 298,258

[22] Filed: Jan. 17, 1989

Related U.S. Application Data

[63] Continuation of Ser. No. 81,792, Aug. 5, 1987, abandoned.

[51] Int. Cl.[5] ..... B65D 27/00

[52] U.S. Cl. ..... 229/92.1; 229/73; 229/69

[58] Field of Search ..... 229/92.1, 73, 70, 71, 229/69

[56] References Cited

U.S. PATENT DOCUMENTS

| | | | |
|---|---|---|---|
| 3,126,148 | 3/1964 | Hanson | 229/92.1 |
| 3,228,586 | 1/1966 | Hayes, Jr. | 229/73 |
| 3,270,948 | 9/1966 | Donovan | 229/73 |
| 3,652,007 | 3/1972 | MacDougall | 229/73 |

FOREIGN PATENT DOCUMENTS

| | | | |
|---|---|---|---|
| 46812/68 | 6/1970 | Australia . | |
| 0128643 | 12/1984 | European Pat. Off. . | |
| 7527578 | 4/1977 | France . | |
| 7725892 | 3/1979 | France . | |
| 638778 | 6/1950 | United Kingdom | 229/92.1 |
| 1594798 | 8/1981 | United Kingdom . | |

*Primary Examiner*—Willis Little

*Attorney, Agent, or Firm*—Cushman, Darby & Cushman

[57] ABSTRACT

A mailer made of rectangular (or square) sheet of paper with strips of adhesive along given edges which may be folded along two fold lines to provide an eccentric Z-folded article suitable for mailing, with inserts nested therein if desired.

9 Claims, 2 Drawing Sheets

ECCENTRIC "Z" FOLD MAILER WITH NESTING CAPABILITIES

This is a continuation of application Ser. No. 07/081,792, filed Aug. 5, 1987 now abandoned, which was abandoned upon the filing hereof.

This invention pertains to mailers, and particularly one of simple construction using a minimum of sheet material that is made up on an eccentric Z-folded sheet which requires printing on one side only, and which may accommodate nested inserts.

BACKGROUND OF INVENTION

There is an extensive need for mailers of simple and inexpensive construction which may be rapidly printed and folded for mailing at a minimum of expense, and the mailer should be able to contain one or more inserts. Also, it is desirable that windows through which addresses may be viewed be eliminated. The present invention achieves these aims.

GENERAL DESCRIPTION OF THE INVENTION

In accordance with the present invention a sheet of paper or the like may be printed on one side only, to have the address information on the lower area of the sheet. Lines of adhesive are then applied to the same side of the sheet as the text along the side edges of the lower area, and on the opposite side of the sheet along the side edges of the top area. The top area is a substantially lesser height than one-half of the lower area. The sheet is then Z-folded, with a nested insert or inserts enclosed, and then heat applied to activate the adhesive strips. A completed mailer is thus provided.

Discussion of Prior Art

Others have earlier thought to provide mailers by folding over sheets of paper in various ways, see U.S. Patents to Kirchof Nos. 3,352,481; to Draemel 894,124; to Zabek 1,794,223; to Krohn 2,772,638 and to Kirchof 3,352,481. However, none of these approach the eccentric Z-fold configuration of the present invention. U.S. Patents to Hardie 1,803,704 and to Hanson 3,152,800 do involve Z-fold configurations, but lack important features of the present invention. Hardie has a full length third flap, and requires side flaps for securing the mailer together. Hanson not only has a full length third flap, but two additional longitudinal flaps as well.

An illustrative embodiment of the present invention will next be provided, with reference to accompanying drawings.

DETAILED DESCRIPTION OF ILLUSTRATIVE EMBODIMENT

Figure 2:
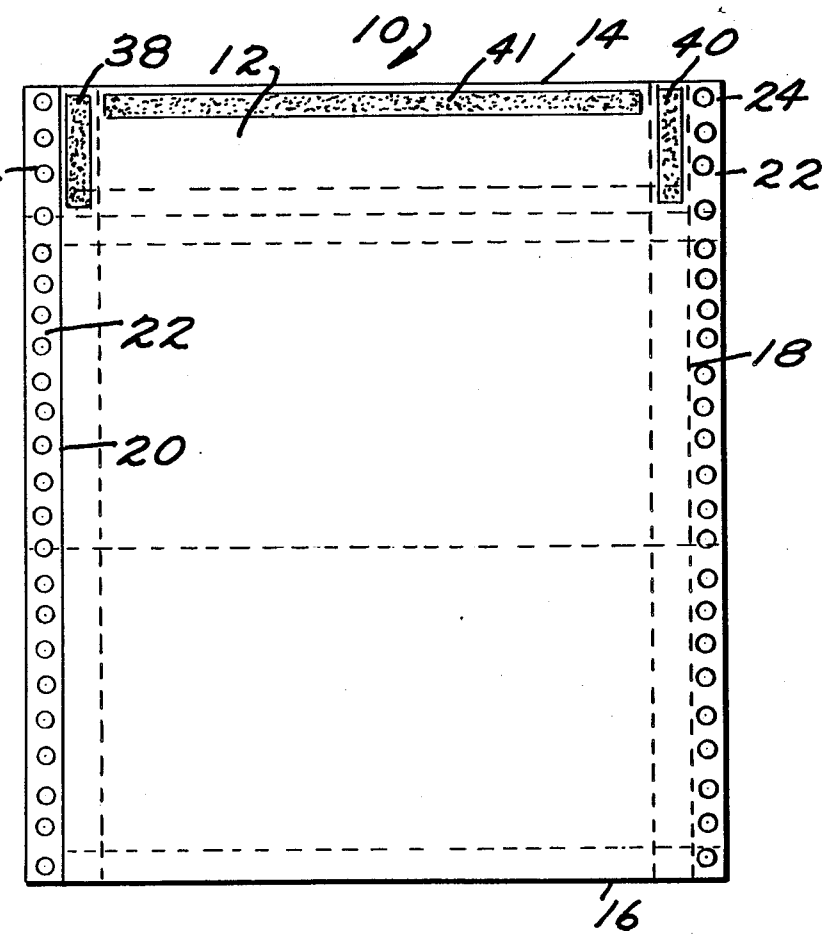
FIG. 2 is a view of the rear surface of the sheet of FIG. 1, turned over from left to right.

Referring to the drawings, the mailer 10 is made up of a sheet of paper 12 having a top edge 14, a bottom edge 16, a side edge 18 and a side edge 20. Detachable margins 22 with tractor holes 24 therein may be used for handling in automated processing equipment.

Figure 1:
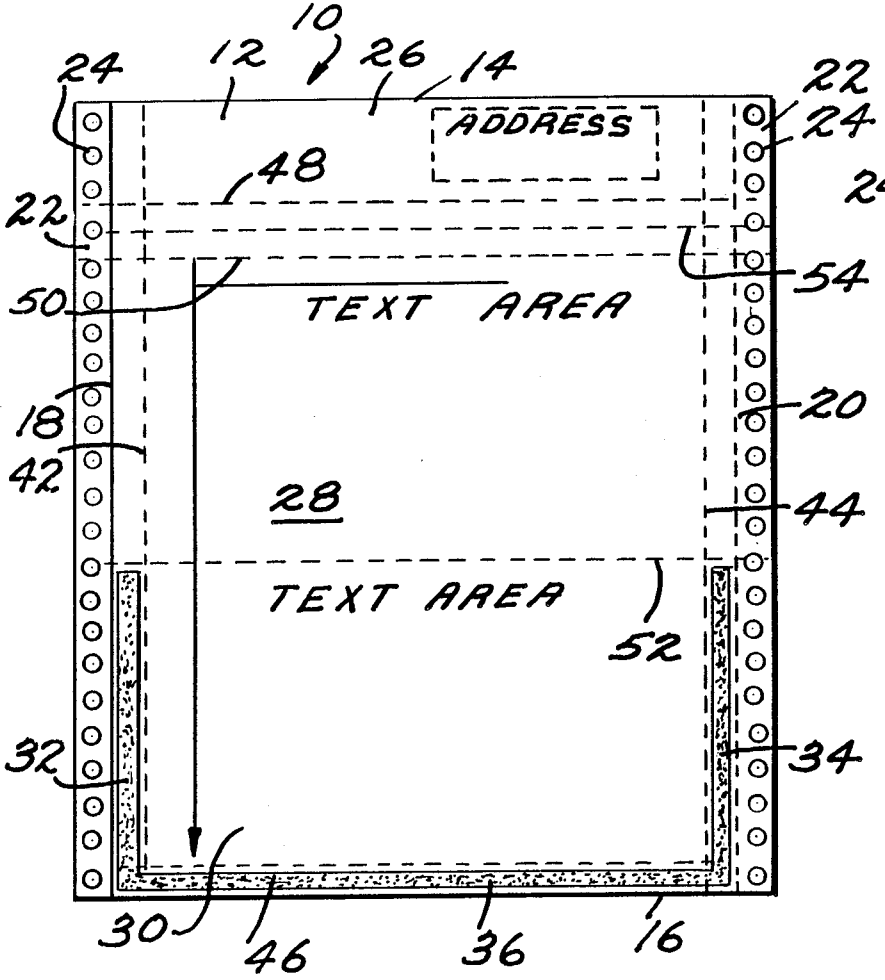
FIG. 1 is a view of the front side of a sheet from which the mailer is constructed.

As the mailer is formed the first step will be printing on the front surface (FIG. 1). Address information will be printed on a top area 26, while text information will be printed on a mid-area 28 and on a bottom area 30. This printing may be done by the computerized variable printing process if desired.

The next step in forming the mailer will be to place strips of heat seal adhesive on the paper 12. Strips 32, 34 and 36 are placed along the boarders of the front surface of the bottom area 30, as shown in FIG. 1. Strips 38 and 40 are placed at the sides of the rear surface of the top area 26, as shown in FIG. 2. Also, a strip of adhesive 41 may be placed (but, not required) on the rear surface along the top edge 14.

It will be understood that the strips of adhesive adjacent the respective side edges may be placed anywhere along the edges so long as there will be adequate adhesive to properly seal the mailer 10 when completed to satisfy users and postal authorities. In other words, the adhesive may be intermittent, such as dots. When "strip" of adhesive is used in the appended claims such intermittent coverage is included.

To facilitate opening of the mailer 10, as described hereinafter, lines of weakening (perforation lines) 42, 44, 46, 48 and 50 are provided.

Figure 3:
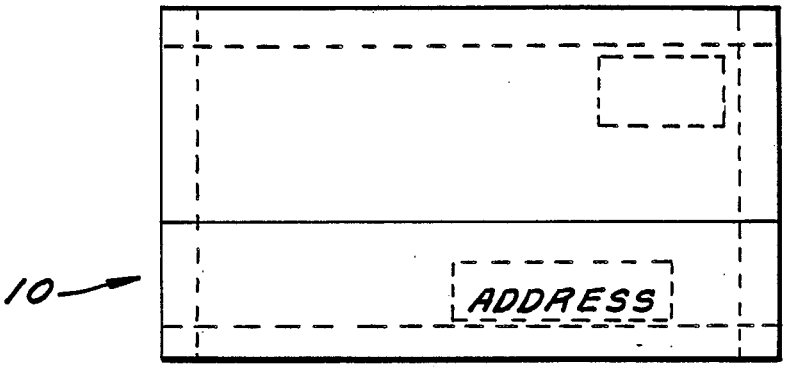
FIG. 3 shows the mailer which results from the Z-folding of the sheet of FIGS. 1 and 2.
Figure 4:
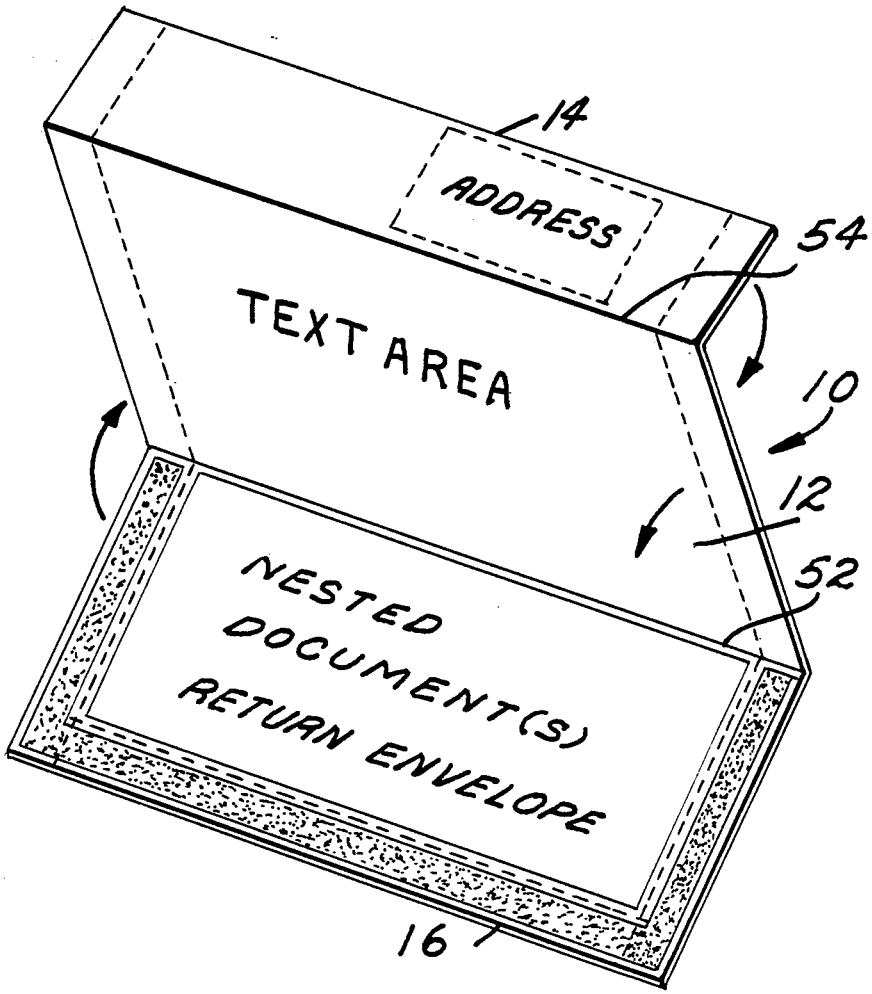
FIG. 4 is an isometric view of the sheet of FIGS. 1 and 2 in the folding process, and with a nested insert in place.

FIG. 3 shows the mailer 10 folded and ready for mailing. The manner of folding is shown in FIG. 4. There are two folds, one along line 52, and the other along line 54. The directions of folding are shown by the arrows in FIG. 4.

As shown in FIG. 1, the line of weakness 42 is positioned inwardly of the adhesive strip 32, that is, the adhesive strip 32 is positioned between the edge 18 and parallel line of weakness 42. In a similar manner, the line of weakness 44 is positioned inwardly of the adhesive strip 34 so that the adhesive strip 34 is positioned between the edge 20 and the parallel line of weakness 44. Likewise, the line of weakness 46 is positioned inwardly of the adhesive strip 36 so that the adhesive strip 36 is positioned between the bottom edge 16 and parallel line of weakness 46. The lines of weakness 48 and 50 are on opposite sides of the fold line 54 with the line of weakness 48 positioned between the top edge 14 and the fold line 54 and the line of weakness 50 positioned inwardly of the fold line 54.

The top area (FIG. 1) of the mailer 10 is substantially of less height than the areas 28 and 30 (which are of equal height). The height of the top area need only be enough for receiving address information and meet postal specifications.

As shown in FIG. 1, the distance between the top edge 14 and the fold line 54 is less than one-third that of the distance between the first and second fold lines 54 and 52 which define the test areas 28.

If the lines of weakness 42, 44, 46, 48 and 50 are created in the sheet 12, the mailer 10 may be opened by the user tearing off the marginal regions. The usual legend, "To Open Tear Along Dotted Line" may be printed along the vertical margins of the completed mailer 10, albeit in that case some printing would be necessary on the rear surface of the sheet 12.

It will be noted that the mailer 10 is constructed from a rectangular (or square) sheet of paper, with no need for special cutting to provide side flaps. All of the adhesive strips lie along the edges of the sheets, rather than being on side flaps or the like.

Upon reading the foregoing disclosure various other embodiments of the invention will occur to others. Therefore, the scope of the invention is to be determined from the appended claims.

What is claimed is:

1. A mailer comprising a sheet having front and rear surfaces and having top, bottom and side edges, the top and bottom edges parallel to one another and the side edges parallel to one another, first and second fold lines located between and parallel to the top and bottom edges, an address area between the top edge and the first fold line, a text area between the first fold line and the bottom edge, the distance between the top edge and the first fold line being substantially less than the distance between the first and second fold lines, a first strip of adhesive on the front surface adjacent one side edge between the bottom edge and the second fold line, a second strip of adhesive on the front surface adjacent the other side edge between the bottom edge and the second fold line, a third strip of adhesive on the front surface of the sheet adjacent the bottom edge, respective strips of adhesive on the rear surface adjacent to each side edge between the top edge and the first fold line, the arrangement being such that the sheet may be Z-folded to place the text area on the inside and the address area on the outside of the mailer, and when activated the strips of adhesive will seal the mailer along the edges.

2. A mailer as in claim 1 and further including a strip of adhesive on the rear surface of the sheet adjacent to the top edge, to further seal the top edge of the mailer when the adhesive is activated.

3. A mailer as in claim 1 further comprising at least one insert nested within the mailer between the bottom edge and the fold lines.

4. A mailer as in claim 2, wherein the distance between the top edge and the first fold line is about one-third the distance between the first and second fold lines.

5. A mailer as in claim 4, further comprising:

a respective first line of weakness positioned inwardly of said first strip of adhesive and a respective second line of weakness positioned inwardly of said second strip of adhesive.

6. A mailer as in claim 5, further comprising:

a third line of weakness positioned inwardly of said third strip of adhesive.

7. A mailer as in claim 6, further comprising:

a fourth line of weakness positioned inwardly of said first fold line.

8. A mailer as in claim 7, further comprising:

a fifth line of weakness positioned between the top edge and the first fold line.

9. A mailer as in claim 8, further comprising:

detachable margin strips attached to each side edge.

* * * * *

UNITED STATES PATENT AND TRADEMARK OFFICE

CERTIFICATE OF CORRECTION

PATENT NO. : 4,928,875

DATED : May 29, 1990

INVENTOR(S) : HUTCHINSON, Will

It is certified that error appears in the above-identified patent and that said Letters Patent is hereby corrected as shown below:

On the Title page, above the line "Appln. No.: 298,258" insert the following two lines:

[73] Assignee: Moore Business Forms, Inc.
Glenview, Illinois

Signed and Sealed this

Tenth Day of March, 1992

*Attest:*

HARRY F. MANBECK, JR.

*Attesting Officer*

*Commissioner of Patents and Trademarks*